US006771054B2

(12) United States Patent
Duval

(10) Patent No.: US 6,771,054 B2
(45) Date of Patent: Aug. 3, 2004

(54) CURRENT GENERATOR FOR LOW POWER VOLTAGE

(75) Inventor: Benjamin Duval, Saint-Maximin (FR)

(73) Assignee: STMicroelectronics S.A. (FR)

( * ) Notice: Subject to any disclaimer, the term of this patent is extended or adjusted under 35 U.S.C. 154(b) by 6 days.

(21) Appl. No.: 10/232,767

(22) Filed: Aug. 29, 2002

(65) Prior Publication Data

US 2003/0071600 A1 Apr. 17, 2003

(30) Foreign Application Priority Data

Sep. 3, 2001 (FR) ..... 01 11356

(51) Int. Cl.[7] ..... G05F 3/16
(52) U.S. Cl. ..... 323/313; 313/315
(58) Field of Search ..... 323/313, 312, 323/314, 315, 316; 327/538, 540, 541, 542

(56) References Cited

U.S. PATENT DOCUMENTS 4,727,309 A 2/1988 Vajdic et al. ..... 323/315
5,373,226 A * 12/1994 Kimura ..... 323/313
5,949,278 A 9/1999 Oguey ..... 327/543

FOREIGN PATENT DOCUMENTS

FR 2688903 4/1992
GB 2265479 4/1992

OTHER PUBLICATIONS

French Search Report, FR 0111356, dated Jun. 21, 2002.

* cited by examiner

*Primary Examiner*—Rajnikant B Patel
(74) *Attorney, Agent, or Firm*—Jenkens & Gilchrist, P.C.

(57) ABSTRACT

A current generator for the production of a reference current includes a first P type transistor, a source of which is connected to a first pole of a resistor and a gate of which is connected to a second pole of the resistor. The reference current flows in the resistor with a value that is a function of a threshold voltage of the first transistor. The current generator further includes a second N type transistor whose drain, gate and source are connected respectively to the second pole of the resistor, the first pole of the resistor and the drain of the first resistor. The second transistor is configured to operate in saturation mode.

25 Claims, 1 Drawing Sheet

Art Antérieur

Art Antérieur

CURRENT GENERATOR FOR LOW POWER VOLTAGE

CROSS REFERENCE

The present application claim priority from French Patent Application No. 01 11356, filed Sep. 3, 2001, the disclosure of which is hereby incorporated by reference.

BACKGROUND OF THE INVENTION

1. Field of the Invention

The invention relates to a reference current generator that is particularly useful for integrated circuits using low supply voltages. A generator according to the invention produces a current independent of the supply voltage.

2. Description of the Prior Art

To create currents independent of the power voltage, there are known ways of using bootstrap type reference current generators, a simplified example of which is shown in FIG. 1.

The generator of FIG. 1 comprises two P type transistors T1 and T2, two N type transistors T3 and T4 and a resistor R1. The drain of the transistor T1 and the drain of the transistor T3 are connected together; a supply voltage VDD is applied to the source of the transistor T1 and a reference voltage VSS is applied to the source of the transistor T3. The source of the transistor T2 is connected to the source of the transistor T1, and the gate and the drain of T2 are connected together to the gate of T1 and to the drain of T4. Finally, a pole of the resistor R1 is connected to the source of T4 and the reference voltage VSS is applied to another pole of the resistor R1.

The generator of FIG. 1 works as follows. Currents I1 and I2, respectively, cross the transistors T1 and T2, which form a current mirror. The currents I1 and I2 are proportional to each other or, possibly, equal: I1=a*I2.

The current I1 crosses the transistor T3, imposing a voltage VTN3 between the gate and the source of T3; where VTN3 is the threshold voltage of the transistor T3, and is independent of the supply voltage VDD.

The current I2 crosses the resistor R1 and a voltage R1*I2 appears across its terminals. Since the resistor R1 is connected between the gate and the source of the transistor T2, at equilibrium, we have R1*I2=VTN3 giving:

$$I2=VTN3/R1.$$

The current I2 is thus independent of the supply voltage VDD, as it depends only on the threshold voltage of the transistor T3 and the resistor R1.

The current I2 obtained may be copied for other uses. For example, it may be copied by means of a copying transistor T5, whose gate and source are respectively connected to the poles of the resistor R1. The drain of the transistor T5 is connected to the ancillary circuit which uses the reference current flowing in the transistor T5. The reference current is directly proportional to the current I2 flowing in the resistor R1.

It will be noted that the current I2, while independent of the supply voltage VDD, is on the contrary dependent on the temperature of the circuit because the threshold voltage VTN3 is itself linearly dependent on the temperature. We have:

$$I2=(VTN3(T0)-K(T-T0))/R1, \text{ with}$$

T being the temperature;

T0 being a reference temperature; and

VTN3(T0) being the threshold voltage of T3 at the temperature T0.

The variation, as a function of the temperature, of the current produced by a generator is not necessarily a drawback. Indeed, certain circuits use reference currents whose value is variable as a function of the temperature.

If not, it is fairly easy to accept a variable current such as the one produced by a generator according to FIG. 1, inasmuch as the variations of the threshold voltage VTN3 as a function of the temperature T are known and are, furthermore, simple: the threshold voltage VTN3, and therefore the current I2 that crosses the resistor R1, varies linearly as a function of the temperature: I2 is indeed equal to I2=I0*(I−b*T).

If a constant current is necessary, there are known ways of combining a generator that produces an I=I0*(1+b*T) type current with a generator producing an I=I0*(1−b*T) type current to obtain a current independent of the temperature.

To create currents, there are also known ways of using reference current generators that use a bipolar transistor. A simplified example of a reference generator of this kind is shown in FIG. 2.

As compared with the generator of FIG. 1, the circuit of FIG. 2 additionally comprises a bipolar transistor T6. An emitter of the transistor T6 is connected to the source of T3 and the reference voltage VSS is applied to a collector and a base of T6 which are connected together. Finally, the gate of T3 is no longer connected to the source of T4 but to its gate.

The generator of FIG. 2 works similarly to FIG. 1. The current I2 flowing in the resistor R1 is simply equal in this case to:

$$I2=VBE6/R1,$$

VBE6 being a threshold voltage between the base and the emitter of the transistor T6 and being independent of the supply voltage VDD. On the contrary, VBE6 depends on the temperature linearly.

Additional information on the making of generators such as those shown in a diagrammatic view in FIG. 1 or FIG. 2 may be found in the document: "CMOS Analog Circuit Design", Editions Holt Rinehart and Winston 1987.

The generators according to FIG. 1 or FIG. 2 are used whenever it is desired to obtain a reference current independent of the supply voltage. This need arises frequently because the supply voltage of a circuit can often vary. Indeed, this voltage often depends on the power given to the circuit.

However, the generators according to FIG. 1 or FIG. 2 have a major drawback related to the value of the minimum supply voltage VDDMin to be used to supply such generators. Indeed, the supply voltage VDD applied must be sufficient to turn on or even saturate all the transistors of the generators, so that a current flows in these transistors.

For example, for the generator of FIG. 1, the minimum voltage VDDmin to be applied is equal to:

$$VDD\text{min}=VTN3+VDS4+VGS2, \text{ with:}$$

VTN3, threshold voltage of T3, on the order of 0.60 V, and

VDS4, voltage between the drain and the source of the transistor T4, on the order of 0.15 V, and VGS2, voltage between the gate (or the drain, since they are connected together) and the source of T2, on the order of 0.70 V.

Consequently, the voltage VDDmin for the circuit of FIG. 1 is on the order of 1.5 V.

In the same way and for the same reasons, for the circuit of FIG. 2, the minimum supply voltage VDDmin to be used is equal to:

$$VDD\text{min}=VBE5+VGS3+VDS1, \text{ with:}$$

VBE5, voltage between the emitter and the base of T5, on the order of 0.7 V, VGS3, voltage between the gate and the source of the transistor T3, on the order of 0.65 V, and VDS1, voltage between the drain and the source of T1, on the order of 0.15 V.

Consequently, the voltage VDDmin necessary to power the circuit of FIG. 2 is on the order of 1.5 V.

Thus, whatever the known current generator used, the minimum supply voltage VDDmin to be used is on the order of 1.5 V.

Now, a minimum voltage of this kind may be prohibitive, especially for circuits made by means of the smallest submicron technologies, for example technologies at the 0.25 $\mu$m level or below, which can use only voltages lower than 1.5 V, or even 1.2 V for 0.13 $\mu$m technologies.

SUMMARY OF THE INVENTION

The present invention relates to a current generator for the production of a reference current.

According to an embodiment of the invention, the generator comprises a first P type transistor, a source of which is connected to a first pole of a resistor and a gate of which is connected to a second pole of the resistor, the reference current, flowing in the resistor, being variable as a function of a threshold voltage of the first transistor, and a second N type transistor, having a drain, a gate and a source connected respectively to the second pole of the resistor, the first pole of the resistor and the drain of the first resistor, the second transistor working in saturation mode.

The reference current produced is thus fixed by the voltage between a gate and a source of the first transistor, which is itself equal to the threshold voltage of the transistor. The reference current produced therefore does not depend on the supply voltage.

In an embodiment of the invention, the above generator is advantageously supplemented by a current source comprising a first pole to which a supply voltage is applied and a second pole connected to the first pole of the resistor.

The current source that is used provides current and power to the resistor and the first transistor. In particular, it gives the reference current flowing in the resistor and the current in the first transistor.

The first transistor and the second transistor are chosen so as to be adequately sized (in terms of gate length/width) so that they are saturated in normal operation of the generator. Thus, as shall be seen further below, the current flowing in the transistor is very low and a current given by the current source is very close to the reference current produced by the current generator according to the invention.

In an embodiment of the invention, a reference current is applied to the drain of the first transistor.

For the generator according to an embodiment of the invention, the minimum supply voltage to be applied is equal to the sum of the voltage between the gate and the source of the second transistor and the voltage between the poles of the current source. It is therefore lower (in the range of 1 to 1.2 V) than the voltage applied for known generators, as shall be seen more clearly here below in the examples.

The uses to which a current generator according to the invention can be put therefore includes the making of circuits in the finer technologies having a low supply voltage.

The generator according to an embodiment of the invention is advantageously supplemented by a third transistor, which is an N type transistor, having a gate and a source connected respectively to the gate and the source of the second transistor.

The third transistor and the second transistor thus form a current mirror: the third transistor copies the reference current flowing in the second transistor and a current proportional (or equal) to the reference current (and therefore independent of the supply voltage) is thus accessible at the drain of the third transistor and may be used by an external circuit.

According to an embodiment of the invention, the current source used in the generator comprises a fourth transistor and a fifth transistor, the supply voltage being applied to the common source of the fourth transistor and of the fifth transistor, the gate of the fourth transistor and the gate of the fifth transistor being connected together to the drain of fifth transistor and to the drain of the third transistor and the drain of the fourth transistor being connected to the first pole of the resistor.

In accordance with an embodiment of the invention, the current generator includes a first node to which an input current whose value is dependent on supply voltage is applied, the first node dividing the input current into a first and second current. A first transistor is connected to the first node and operates to pass the first current. A resistor is connected to the first node and passes the second current. In this configuration, the value of the second current is independent of supply voltage and is approximately equal to a ratio of a threshold voltage of the first transistor to a resistance of the resistor.

BRIEF DESCRIPTION OF THE DRAWINGS

The invention will be understood more clearly and other features and advantages shall appear from the following description of exemplary embodiments of current generators according to the invention. The description must be read with reference to be the appended drawings, of which.

DETAILED DESCRIPTION OF THE DRAWINGS

Figure 3:
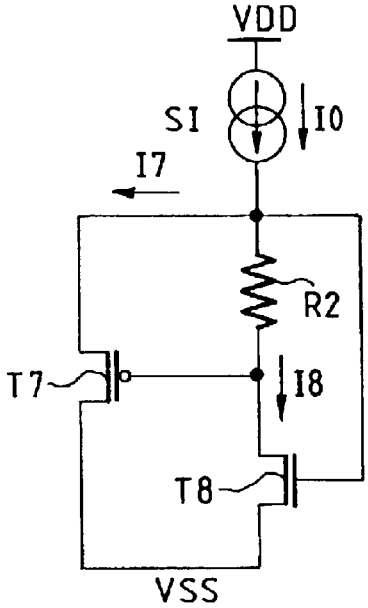
FIGS. 3 and 4 are drawings of current generators according to embodiments of the invention.

In a first exemplary implementation, a current generator according to an embodiment of the invention is shown in FIG. 3 and comprises a current source SI, a P type transistor T7, an N type transistor T8, and a resistor R2. The transistors T7 and T8 are sized so that they are saturated in normal operation.

A supply voltage VDD is applied to a first terminal of the current source SI, which produces a current I0 at a second terminal. The current source SI is not necessarily perfect and, especially, the current I0 may depend on the voltage VDD as well as on any other parameter.

The resistor R2 has a first pole connected to the source of the transistor T7, the gate of the transistor T8 and the second terminal of the current source SI. The resistor R2 has a second pole connected to the gate of T7 and the drain of T8.

A reference voltage VSS is applied to the source of T8 and to the drain of T7 which are connected together. The reference voltage VSS is lower than the supply voltage VDD. The voltage VSS corresponds for example to a ground voltage of the circuit.

The generator of FIG. 3 works as follows. The source SI produces the current I0, which is variable as the case may be, and is divided into a current I8, crossing the resistor R2, and a current I7, flowing between the source and the drain of the transistor T7.

The transistor T7 is on and saturated (it has been sized for this). Consequently, the current I7 is very low. In particular, it is far lower than the current I8. The voltage between the gate and the source of the transistor T7 is equal to:

$$VGS7=VTP7+VDsat, \text{ with}$$

VGS7 being the voltage between the gate and the source of the transistor T7,

VTP7 being the threshold voltage of the P type transistor T7, on the order of 0.60 V, and Vdsat being the voltage between the drain and the source of T7, at the saturation point. VDsat is very low, for example of the order of 0.05 V.

It is deduced therefrom that that voltage between the gate and the source of T7 is approximately equal to the threshold voltage of the transistor T7. Since the voltage at the terminals of the resistor R2 is equal to the voltage between the gate and the source of the transistor T7, the current I8 flowing in the resistor R2 is finally equal to:

$$I8=VTP7/R2.$$

Since the threshold voltage VTP7 and the resistance R2 are independent of the supply voltage VDD, there is obtained, as in the case of the prior art generators, a current I8 independent of the supply voltage VDD. The current I8 depends, however, on the temperature T because the threshold voltage VTP7 depends on it according to the relationship:

$$VTP7(T)=VTP7(T0)-K(T-T0), \text{ where}$$

T0 is a reference temperature,

K is a constant, and

VTP7(T0) is a reference value of the threshold voltage associated with the temperature T0.

Figure 4:
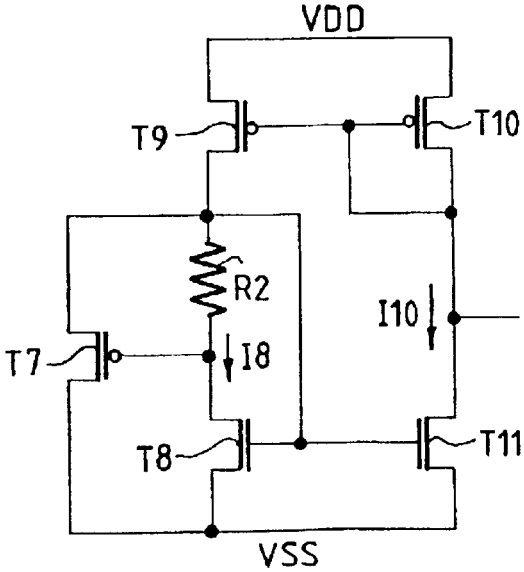

Another example of a current generator according to an embodiment of the invention is shown in FIG. 4. As compared with the generator of FIG. 3, the generator of FIG. 4 additionally comprises two P type transistors T9, T10 and an N type transistor T11. The transistors T9, T10 in this example form the current source SI.

The supply voltage VDD is applied to the common source of the transistors T9 and T10 whose gates are connected together, the gate of T10 being also connected to its drain. The drain of T9 is connected to the first pole of the resistor R2 and to the source of the transistor T7; the transistor T9 produces the current I0.

Since the transistor T7 is saturated, as in the above example, the current I7 flowing in the transistor T7 is very weak and there is little difference between the current I8 flowing in the resistor R2 and the current I0. The current I8 is copied by the transistors T10, T11. Consequently, a current I0 flows in the transistors T10, T11, the current I10 being directly proportional to the current I8. The current I11 is therefore independent of the supply voltage VDD, but varies linearly with the temperature.

In the example of FIG. 4, the transistors T9, T10 form the current source SI. However, other types of current sources may of course be used to make the source SI. What is essential is that there should be a source capable of giving a current I0 that is sufficient firstly to power and saturate the transistor T7 and, secondly to power the resistor R2.

It will be noted that, with the generator of FIG. 3 or that of FIG. 4, the minimum voltage VDDmin to be applied to the generator is equal to:

$$VDDmin=VGS8+VSI, \text{ with}$$

VGS8 being the voltage between the gate and the source of the transistor T8, on the order of 0.6 to 0.9 V, and VSI being the voltage across the terminals of the current source SI; if the source SI is made (according to FIG. 4) by means of the transistors T9, T10, then the voltage VSI is equal to the voltage between the drain and the source of the transistor T9. It is therefore on the order of 0.2 V.

Figure 1:
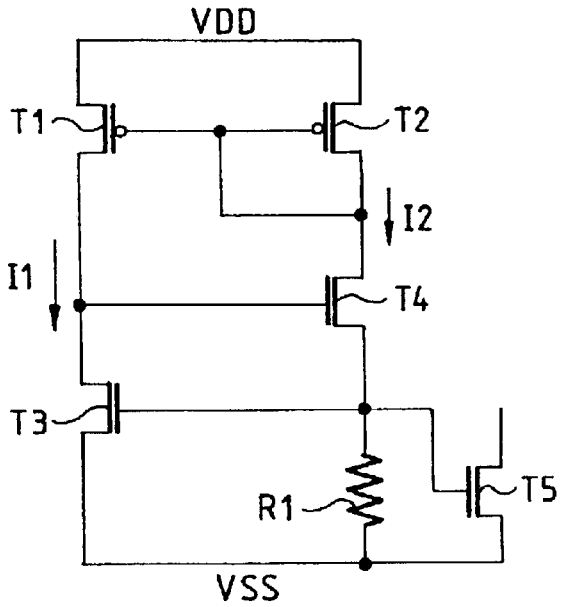
FIGS. 1 and 2, already described, are drawings of prior art current generators.
Figure 2:
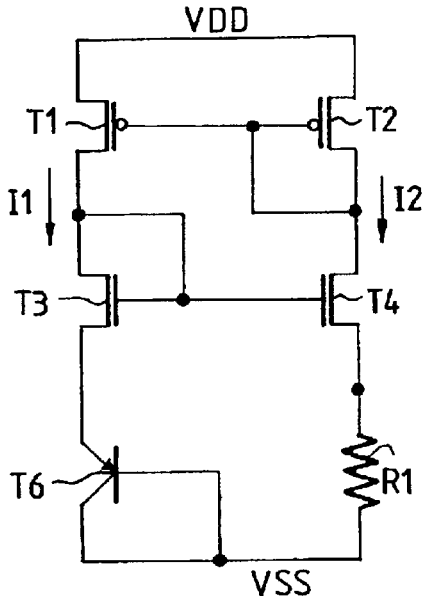

The minimum supply voltage to be used is thus in the range of VDDmin=0.8 to 1.1 V, which is quite below the voltage VDDmin that it is necessary to use in known generators such as those of FIG. 1 or FIG. 2. A current generator according to the invention may therefore be used for any type of integrated circuit, including the integrated circuits made according to the finer technologies, for example the 0.13 $\mu$m technologies which use a low supply voltage.

It will be noted that, just as in the known circuits, the current produced by a generator according to the invention depends on the temperature since the threshold voltage VTP7 of the transistor T7 itself depends on it. However, this is not more of an inconvenience than it is in the case of known circuits: the variations of the threshold voltage VTP7, and therefore of the current I8, as a function of the temperature are known. They are more linear and can therefore be easily taken into account.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A current generator producing a reference current, comprising:

a resistor in which the reference current flows;

a first transistor, a source of which is connected to a first pole of the resistor and a gate of which is connected to a second pole of the resistor, the reference current flowing in the resistor being variable as a function of a threshold voltage of the first transistor; and a second transistor having a drain, a gate and a source connected respectively to the second pole of the resistor, the first pole of the resistor and the drain of the first transistor, the second transistor working in saturation mode.

2. The current generator according to claim 1 wherein the first transistor of P type and the second transistor is of N type.

3. The generator according to claim 1, further comprising a current source comprising a first pole to which a supply voltage is applied and a second pole connected to the first pole of the resistor.

4. The generator according to claim 1, wherein a reference voltage is applied to the drain of the first transistor.

5. A current generator producing a reference current, comprising:

a resistor in which the reference current flows;

a first transistor, a source of which is connected to a first pole of the resistor and a gate of which is connected to a second pole of the resistor, the reference current flowing in the resistor being variable as a function of a threshold voltage of the first transistor;

a second transistor having a drain, a gate and a source connected respectively to the second pole of the resistor, the first pole of the resistor and the drain of the first transistor, the second transistor working in saturation mode; and a third transistor having a gate and a source connected respectively to the gate and to the source of the second transistor.

6. The generator according to claim 5 wherein the third transistor is of N type.

7. The generator according to claim 5, wherein the current source comprises a fourth transistor and a fifth transistor, a supply voltage being applied to a common source of the fourth transistor and of the fifth transistor, a gate of the fourth transistor and a gate of the fifth transistor being connected together to a drain of fifth transistor and to a drain of the third transistor and a drain of the fourth transistor being connected to the first pole of the resistor.

8. A current generator circuit, comprising:

a first node to which an input current whose value is dependent on supply voltage is applied, the first node dividing the input current into a first and second current;

a first transistor connected to the first node, operating in saturation mode and through which the first current passes; and a resistor connected to the first node and through which the second current passes, the value of the second current being independent of supply voltage and approximately equal to a ratio of a threshold voltage of the first transistor to a resistance of the resistor.

9. The current generator circuit of claim 8 further including a second transistor through which the second current passes, the second transistor having a control terminal connected to the first node.

10. The current generator circuit of claim 9 further including a second node interconnecting the resistor to the second transistor, the second node being connected to a control terminal of the first transistor.

11. The current generator circuit of claim 9 wherein the second transistor operates in saturation mode.

12. A current generator circuit, comprising:

a first node to which an input current whose value is dependent on supply voltage is applied, the first node dividing the input current into a first and second current;

a first transistor connected to the first node, operating in saturation mode and through which the first current passes;

a resistor connected to the first node and through which the second current passes, the value of the second current being independent of supply voltage and approximately equal to a ratio of a threshold voltage of the first transistor to a resistance of the resistor; and a current generator supplying the input current.

13. The current generator circuit of claim 12 wherein the current generator comprises a current mirror, the current mirror producing the input current on a first leg thereof and a mirror current on a second leg thereof.

14. The current generator circuit of claim 13 wherein the mirror current is proportional to the second current.

15. The current generator circuit of claim 14 further including a fourth transistor through which the mirror current passes, the fourth transistor having a control terminal connected to the first node.

16. A current generator, comprising:

a node to which an input current is applied, the node dividing the input current into a first and second current;

a first transistor connected to the node for source/drain terminal passage of the first current;

a resistor connected to the node and across the source/gate terminals of the first transistor, and through which the second current flows; and a second transistor connected to the resistor for drain/source terminal passage of the second current and having a gate terminal connected to the node.

17. The current generator as in claim 16 further including a current generator supplying the input current.

18. A current generator, comprising:

a node to which an input current is applied, the node dividing the input current into a first and second current;

a first transistor connected to the node for source/drain terminal passage of the first current passes;

a resistor connected to the node and across the source/gate terminals of the first transistor, and through which the second current flows; and a second transistor connected to the resistor for drain/source terminal passage of the second current and having a gate terminal connected to the node; and a current source supplying the input current comprising a current mirror, the current mirror producing the input current on a first leg thereof and a mirror current on a second leg thereof.

19. The current generator circuit of claim 18 wherein the mirror current is proportional to the second current.

20. The current generator circuit of claim 19 further including a fourth transistor connected for drain/source terminal passage of the mirror current, the fourth transistor having a gate terminal connected to the node.

21. A current generator producing a reference current, comprising:

a resistor in which the reference current flows;

a p-channel transistor having a source of which is connected to a first pole of the resistor and receiving a current that places the p-channel transistor is saturation mode, the p-channel transistor further having a gate connected to a second pole of the resistor, the reference current flowing in the resistor being variable as a function of a threshold voltage of the p-channel transistor; and a n-channel transistor having a drain connected to the second pole of the resistor, a gate directly connected to the first pole of the resistor and a source connected to the drain of the first transistor.

22. A current generator producing a reference current, comprising:

a resistor in which the reference current flows;

a first transistor, a source of which is connected to a first pole of the resistor and a gate of which is connected to a second pole of the resistor, the reference current flowing in the resistor being variable as a function of a threshold voltage of the first transistor; and a second transistor having a drain, a gate and a source connected respectively to the second pole of the resistor, the first pole of the resistor and the drain of the first transistor, the second transistor working in saturation mode.

23. The generator according to claim 22, further comprising a current source comprising a first pole to which a supply voltage is applied and a second pole connected to the first pole of the resistor.

24. The generator according to claim 22, further comprising a third transistor having a gate and a source connected respectively to the gate and to the source of the second transistor.

25. The generator according to claim 24, wherein the current source comprises a fourth transistor and a fifth transistor, a supply voltage being applied to a common source of the fourth transistor and of the fifth transistor, a gate of the fourth transistor and a gate of the fifth transistor being connected together to a drain of fifth transistor and to a drain of the third transistor and a drain of the fourth transistor being connected to the first pole of the resistor.

* * * * *